US005972066A

United States Patent [19]

Lehtinen

[11] Patent Number: 5,972,066

[45] Date of Patent: Oct. 26, 1999

[54] MIXED BED IRON REDUCTION PROCESS

[75] Inventor: Larry J. Lehtinen, Westlake, Ohio

[73] Assignee: Iron Dynamics, Inc., Butler, Ind.

[21] Appl. No.: 08/841,468

[22] Filed: Apr. 22, 1997

[51] Int. Cl.[6] ..... C21B 11/10

[52] U.S. Cl. ..... 75/10.63; 75/484; 75/961

[58] Field of Search ..... 75/484, 10.63, 75/961

[56] References Cited

U.S. PATENT DOCUMENTS

| | | | |
|---|---|---|---|
| 2,793,109 | 5/1957 | Hudbler et al. | 75/3 |
| 4,207,093 | 6/1980 | Pastorino et al. | 75/26 |
| 4,300,948 | 11/1981 | Metz | 75/34 |
| 4,622,905 | 11/1986 | MacDougall et al. | 110/347 |
| 4,636,127 | 1/1987 | Olano et al. | 414/158 |
| 4,676,741 | 6/1987 | Pargeter | 432/142 |
| 4,701,214 | 10/1987 | Kaneko et al. | 75/38 |
| 5,186,741 | 2/1993 | Kotraba et al. | 75/484 |
| 5,516,358 | 5/1996 | Pargeter et al. | 75/504 |
| 5,567,224 | 10/1996 | Kundrat | 75/484 |
| 5,601,631 | 2/1997 | Rinker et al. | 75/484 |
| 5,637,133 | 6/1997 | Munnix et al. | 75/484 |

*Primary Examiner*—Melvyn Andrews
*Attorney, Agent, or Firm*—Woodard, Emhardt, Naughton, Moriarty & McNett

[57] ABSTRACT

The present invention provides a method for producing direct reduced iron in a continuous and efficient fashion, which includes providing a mixture of a particulate iron oxide composition and a particulate carbonaceous reductant composition; the mixture being substantially unagglomerated and having a moisture content of less than about 14% water by weight; positioning the mixture onto a rotary hearth furnace; subjecting the mixture to reducing conditions to reduce a substantial portion of the iron oxide, thereby producing sponge iron; and discharging the sponge iron from the rotary hearth furnace.

34 Claims, 3 Drawing Sheets

MIXED BED IRON REDUCTION PROCESS

BACKGROUND OF THE INVENTION

1. Field of the Invention

The present invention relates to the direct reduction of iron oxides to elemental iron. More specifically, it relates to direct iron reduction processes utilizing one or more solid carbon reducing agents and a rotary hearth furnace to achieve continuous direct iron reduction.

2. Discussion of Related Art

Skilled artisans in the field of refining iron are increasingly recognizing direct reduction, which involves a chemical reduction reaction at a temperature below the melting temperature of the materials present, as a useful method of converting iron oxides, such as, for example, iron ore, into elemental iron. The two general categories of direct reduction are (1) those that utilize natural gas as the reducing agent, and (2) those that utilize solid carbonaceous materials such as coal as the reducing agent (solid-based direct iron reduction). While solid-based direct iron reduction is presently being given a great deal of attention as a potentially useful reduction mechanism, it is hindered by several efficiency problems. The present invention overcomes many of these problems by providing advantageous processes for achieving continuous direct iron reduction using one or more solid carbon reducing agents and a rotary hearth furnace.

Of all direct reduced iron ("DRI") currently being produced, at least 90% worldwide is produced using natural gas-based processes rather than solid carbon-based processes. These processes which utilize natural gas as the reductant typically involve expensive oxide pellets or lump ore as feed stock. It is believed that the only DRI currently being produced in any significant amount using solids-based processes is produced by the SL/RN or GRATECAR processes, which use oxide pellets or lump ore together with sized coal as the feed material. In these processes, there is no admixing of ground iron ore particles with a finely-divided particulate solid reductant. Rather, the large coal and ore lumps or pellets (typically having sizes of about ⅛ inch to about 2 inches) are fed into a rotary kiln furnace, and the reduction reaction proceeds very slowly, commonly requiring kiln residence times of over 12 hours. Consequently, for a large kiln, the equipment only produces about 50,000 to about 150,000 tons of DRI product per year, and this production involves very large capital costs.

There are currently under development three alternative processes for DRI production using coal as the reductant which utilize a rotary hearth furnace. In these rotary hearth processes for reducing iron ore by carbonaceous direct reduction, ground iron ore and a finely-divided carbonaceous reducing agent, as well as other additives, such as binding agents, are first formed into spherical agglomerates called green balls or into briquettes. One such process, termed the "FASTMET" process herein, involves producing large green balls (nominally 20 mm in diameter) of iron oxide and coal, and utilizes a thermal drier prior to introduction of the balls onto a rotary hearth furnace. The second process, termed the "INMETCO" process herein, is similar to the FASTMET process, but utilizes smaller green balls (nominally 9 to 12 mm in diameter), and does not use a drier. Instead, the green balls are fed "wet" directly onto the rotary hearth furnace. The third process, termed the "MAUMEE" process herein, is similar to the INMETCO process, but utilizes wet or dry briquettes formed under high pressure with or without binder material. The MAUMEE process uses very expensive briquetting machines to form dry or nearly dry briquettes that, depending upon the starting material, may or may not require one or more binders to achieve briquettes strong enough to withstand handling steps onto the hearth of a rotary furnace.

A major focus of developmental work in the field of carbonaceous direct reduction of iron, therefore, is the development of agglomerates having adequate tensile strength and abrasion resistance to prevent powdering or breaking of the agglomerates during conveyance to the rotary hearth. As such, both the FASTMET process and the INMETCO process, as well as other similar processes, have the inherent problem of requiring extremely large dosages of binders. The binders are required in such large proportions in order to make a wet or dry agglomerate of adequate strength and durability to avoid breakage during handling ahead of the drier or rotary hearth furnace, and to avoid exfoliation or explosion in the case of the INMETCO process where wet balls are introduced directly onto the hot hearth of the rotary hearth furnace.

These agglomerates, typically green balls but in some processes briquettes, are charged into a rotary hearth furnace, where the iron ore in the agglomerate is reduced to yield "sponge iron." The term "sponge iron" refers to the product of a direct reduction process and is used interchangeably herein with the term "DRI". The sponge iron, which is still in agglomerate form, normally is then densified by briquetting, shipped and melted to extract the reduced elemental iron from contaminants such as silica and sulfur, which are tightly bound to the elemental iron in the sponge iron product.

All three processes, the FASTMET process, the INMETCO process and the MAUMEE process are accompanied by very large capital and operating costs, which are associated in part with the necessity of binder materials and/or expensive equipment, and processing steps to form the iron ore and other starting materials into agglomerates. For example, the iron ore typically must be ground to a fairly stringent size specification before agglomeration. Additionally, the balling or briquetting step requires large capital costs due to the need for proper machinery for forming and sizing the agglomerates and adding the large amounts of binders needed to form balls or briquettes. Also, the agglomeration step typically requires the addition of moisture to the starting materials. Thus, in the FASTMET process, it is necessary to perform a drying step prior to charging agglomerates into a furnace for direct reduction. This drying step also requires additional machinery as well as large inputs of energy, and it also places greater demands on the strength and durability of the dry, and typically more fragile, green balls so that the dry ball arrives on the reduction hearth largely intact. Therefore, a significant amount of binder is required in the FASTMET process.

One manner of alleviating this problem is to grind the ore and the reductant to a much finer particle size distribution. For example, an agglomerate made for this process using course starting materials (i.e., where about 80% of the particles are less than about 100 $\mu$m in diameter), the mixture to be formed into the agglomerate must typically include from about 0.5 to about 0.6% binder by weight (typically about half organic binders and about half bentonite clay). If, however, relatively fine starting materials are to be used (i.e., where about 80% of the particles are less than about 44 $\mu$m in diameter), the process requires a somewhat smaller proportion of binder. However, grinding itself is associated with added costs, and only reduces the problem, but does not eliminate it.

In the INMETCO process, described above, moist pellets are placed directly into a rotary hearth furnace; however, in this type of process, there are several precautionary measures which must be taken. For example, a green ball cannot be heated too quickly on a hearth or it may explode. One manner of avoiding explosion of these green balls is to cool the hearth before introducing them thereon, this cooling step causing an extremely inefficient waste of heat. Thereafter, the hearth, carrying the green balls, must pass through a drying zone to gradually drive water from the green agglomerates, followed by rapid heating in a reduction zone to bring the agglomerates to a reducing temperature. This need for gradual heating causes thermal inefficiency of a rotary hearth furnace, and hearth cooling reduces hearth refractory life.

In the INMETCO process, it has been proposed that an alternative way to avoid green ball explosion upon rapid heat-up of and water expulsion from the green balls, is to use relatively large quantities of binder agents in the recipe used to make the green balls. This method, however, requires a binder dosage that can be up to 500% higher than the binder dosage required if a drier and relatively fine grinds of starting materials are employed in the process. In this case, the high binder dosage becomes an even more significant operating cost of the process. Overall, the binders required for these processes typically account for about 6 to about 15% of the total production costs for the direct reduction process.

The MAUMEE process, for certain starting materials, may be able to function without binders; however, the resulting briquettes are more fragile than even dry green balls. Therefore, this process requires special and more costly material handling equipment and practices. Furthermore, the MAUMEE process requires high capital costs due to the need for expensive briquetting equipment, and high operating costs due to wear of the molds used in the briquetting machines. All of these considerations, along with the need for intermediate bins and material handling equipment, are associated with large capital and operating costs in reduction processes using green balls, dry pellets, briquettes or other agglomerates as the feedstock. Therefore, there is a great need in the art for a direct reduction process which avoids the need for agglomeration of starting materials.

Another consideration which leads to overall inefficiency and other problems in carbonaceous direct reduction processes of the prior art, is that, due to the relatively low compression strength of wet and, to a lesser extent, dry green balls, it is not feasible to utilize a "surge bin" immediately ahead of the hearth. The term "surge bin," as used herein, refers to a container which holds material to be introduced onto the hearth prior to the introduction thereof. The surge bin may, for example, have coupled thereto a simple table feeder and a conveyor for delivering the feed material directly to the hearth feed system; and provides a buffering function, enabling the reduction process to continue even if one or more process steps for preparing feed material is interrupted due to, for example, equipment failure or planned maintenance. In the direct iron reduction processes known in the prior art, it is not feasible to employ such a surge bin because the wet green balls on the bottom of the bin will squash, deform and break due to the load of balls above them. Dry balls, although stronger than wet balls, will suffer a similar consequence, but to a lesser extent than wet balls.

In carbonaceous reduction processes which utilize green balls, therefore, it is not feasible to use a surge bin due to the physical characteristics of the green balls, and if the functionality of the balling unit is interrupted, the reduction process is halted. As such, the rotary hearth furnace becomes useless until the balling unit regains operability. The stops and starts of the rotary hearth furnace process result in the consumption of excess energy and also the production of off-specification or poor quality DRI. In processes which utilize dry agglomerates, a small amount of surge is possible (limited by the friable nature of the dry balls); however, any substantial interruption will cause this small amount of surge material to be consumed, and will, similarly, cause the reduction process to be disrupted with the attendant cost and quality penalties.

Halting of the reduction process, as occurs when the above situations arise, has extremely disadvantageous economic implications. Examples of these disadvantages include a decrease of annual output; an increased energy cost associated with thermal efficiency (it is costly to maintain the temperature of a rotary hearth furnace which is not in use, yet it is also very expensive to reheat the furnace prior to resuming the reduction process); and interruptions in the process are known to decrease the quality of the output material. Therefore, the inability to utilize surge bins is a substantial disadvantage of prior art processes with respect to annual output, process efficiency and product quality.

The present invention overcomes the aforementioned problems by teaching a process for achieving direct reduction of iron which avoids agglomeration steps and instead involves charging particulate starting materials onto a rotary hearth furnace. By utilizing inventive methods, the above-described problems associated with the formation of and reduction of agglomerates are avoided, along with the large capital and operating costs associated therewith.

SUMMARY

To overcome problems in the prior art relating to the high costs associated with forming and reducing iron ore agglomerates, the present invention provides methods for achieving direct reduction of iron by introducing a mixture of a particulate iron oxide composition and a particulate carbonaceous reductant onto the hearth of a rotary hearth furnace. According to the invention, direct reduction is achieved in a continuous fashion, of unagglomerated starting materials, and the resulting sponge iron may be discharged from the hearth using, for example, one or more water-cooled discharge screws or plows, and passed through sealed refractory-lined chutes into, for example, insulated bottles, a hot briquetting machine to agglomerate and densify the product, a nitrogen-purged hot conveyor for transport to further processing steps, a hot pneumatic conveyance system or a cooler.

According to one aspect of the invention, therefore, there is provided a method for producing direct reduced iron which includes providing a mixture of a particulate iron oxide composition and a particulate carbonaceous reductant; the mixture being substantially free from agglomeration; positioning the mixture onto a rotary hearth furnace; subjecting the mixture to heat and reducing conditions to reduce a substantial portion of the iron oxide, thereby producing sponge iron; and discharging the sponge iron from the rotary hearth furnace. When positioning the mixture onto a rotary hearth furnace, it is preferred that the mixture be positioned in a substantially uniform layer. In particular aspects of the invention, the mixture additionally includes water and/or an additive selected in accordance with the invention.

In one particular preferred embodiment of the invention, after a moist mixture is introduced onto the hearth of a rotary hearth furnace in a substantially uniform layer, the layer is compacted, preferably using one or more rollers, thereby bringing the particles of the various starting materials into closer contact with one another. In alternative preferred embodiments, the roller or other compacting device includes texturing features to impart a textured surface to the layer, thereby increasing the surface area of the layer.

It is an object of the present invention to provide a direct iron reduction process which converts iron oxide compositions into metallic iron at a high conversion efficiency without pelletizing, briquetting or otherwise agglomerating the starting materials prior to placement upon the hearth of a rotary hearth furnace. Inventive processes thereby eliminate the need to grind the iron oxide composition to pelletizing size, the need to use expensive binders and equipment to pelletize or briquette the starting materials, the need to dry green pellets, and the need to carefully handle fragile wet green balls, wet briquettes, dry briquettes or dried pellets prior to introducing them onto the hearth.

It is also an object of the invention to provide a process for the direct reduction of iron which maximizes the utilization of hearth surface area by minimizing the void space between particles, pellets, briquettes or agglomerates on the hearth, thereby maximizing unit productivity of the hearth by placing individual iron oxide particles into close proximity and intimate contact with carbonaceous reductant particles.

Additionally, it is an object of the present invention to provide a process for the direct reduction of iron which maximizes unit productivity of a rotary hearth furnace by minimizing the moisture content of the material introduced thereon, thereby minimizing the drying task required of either the hearth itself or a separate drier, such as those used in conventional process known in the art.

It is another object of the invention to provide a process for directly reducing iron which obviates or reduces the need for ore grinding and classification systems, and the attendant capital and operating costs.

Also, it is an object of the present invention to provide a process for the direct reduction of iron which minimizes operating costs and maximizes unit productivity and product quality of a rotary hearth furnace by allowing a large quantity of feed materials to be held in a surge bin immediately ahead of the rotary hearth furnace, thereby minimizing interruptions to the reduction process.

Further objects, advantages and features of the present invention will be apparent from the drawings and detailed description herein.

BRIEF DESCRIPTION OF THE DRAWINGS

Although the characteristic features of this invention will be particularly pointed out in the claims, the invention itself, and the manner in which it may be made and used, may be better understood by referring to the following descriptions taken in connection with the accompanying drawings forming a part hereof.

DESCRIPTION OF THE PREFERRED EMBODIMENTS

Figure 1:
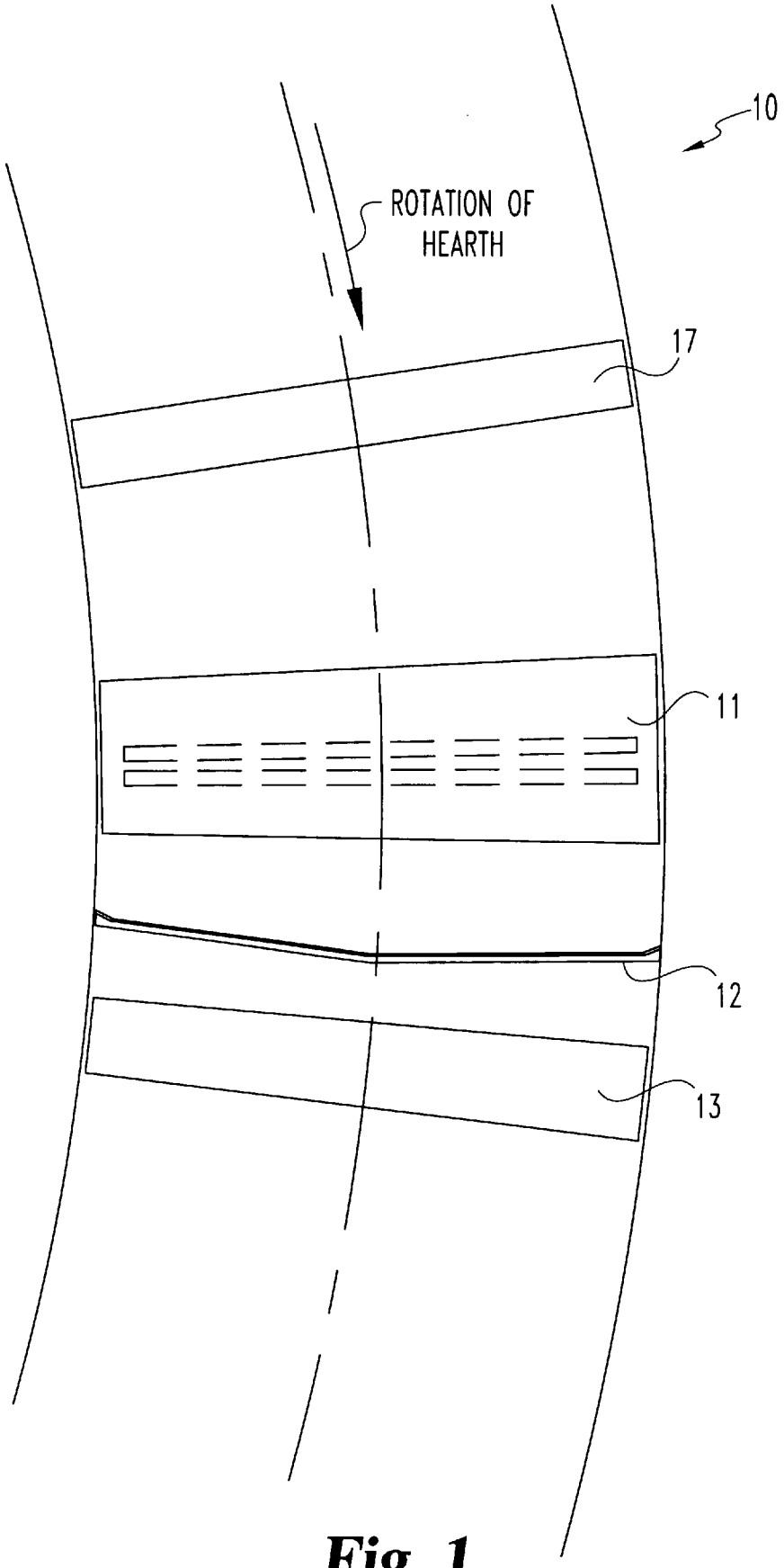
FIG. 1 provides a top plan view of a portion of a rotary hearth furnace according to a preferred aspect of the invention, the portion including the feed zone, and having depicted therein a feed drum for introducing feed material onto the hearth, a leveling plow and a single compacting drum.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention pertains.

The present invention provides improved methods for the direct reduction of iron oxides. These methods eliminate the need for many processing steps and make possible the use of advantageous equipment and materials, thereby greatly reducing capital and operating costs associated with conventional methods of direct reduction of iron. Specifically, the present invention involves iron reduction methods wherein the starting materials charged to a rotary hearth furnace are in particulate form, and are not bound together or "agglomerated," as is required in prior art carbonaceous direct reduction methods which utilize a rotary hearth furnace. This feature of the present invention eliminates the need for the cost-intensive steps associated with agglomerating the starting materials and thereafter reducing the agglomerates. Furthermore, eliminating the need for agglomerating steps also eliminates the need for the large amounts of binders which are often used to achieve agglomeration. Since these binders are very expensive, accounting for as much as 15% of the total costs for these processes, this feature of the invention greatly increases the economic value of direct reduction processes.

One step that is minimized or in some cases eliminated is the step of grinding iron ore to obtain particles having useful sizes for pelletization. Additionally, since no balling, briquetting or agglomeration is required prior to the hearth, no binding agents, balling disks, balling drums, roll screens or briquetting machines are required in inventive processes and capital and operating costs are therefore reduced. Furthermore, since there is no wet agglomeration prior to the hearth, the need for a dryer in the process is eliminated, thereby decreasing capital and operating costs, and the risk of green ball explosion is eliminated, which can occur in methods which involve placing wet green balls onto a hot hearth. Because the moisture content of the mixture placed onto the hearth according to the invention is less than one third that of green balls taught in the prior art, the unit productivity of the hearth furnace is maximized These and other advantages of the present invention will be described in greater detail herein.

According to the present invention, appropriate proportions of particulate starting materials, including one or more particulate iron oxides, one or more particulate carbonaceous reducing agents, and, optionally, one or more additives selected in accordance with the present invention and water, are mixed, and placed in particulate form on the hearth of a rotary hearth furnace. Thereon, the particulate starting materials are exposed to appropriate reaction conditions to achieve direct reduction of the iron oxide into sponge iron. As stated above, the term "sponge iron" is intended to refer to the product of a direct reduction process which includes elemental iron therein, and is used interchangeably with the term "DRI." The sponge iron is then discharged from the rotary hearth furnace for subsequent processing or merchant sale.

One starting material required to practice the present invention, therefore, is a particulate iron oxide composition. The particulate iron oxide composition comprises a sufficient amount of iron oxide to make the direct reduction into metallic iron economically feasible. A preferred level of iron oxide in such a composition may be determined by a skilled artisan on a case-by-case basis for a wide variety of economic conditions and situations. It is contemplated according to the present invention that a wide variety of iron ores, such as virgin ores, or concentrates thereof, may be used in inventive processes. Examples of iron oxide compositions suitable for use according to the invention include virgin iron ore, such as hematite iron ore fines, ground lump ores, iron oxide pellet fines, hematite iron ore, specular hematite concentrate, earthy hematite, magnetite iron ore, magnetite concentrate, limonite, limonite concentrate, ilmenite, ilmenite concentrate, taconite concentrate, semi-taconite concentrate, pyrolusite and pyrolusite concentrate; and steel mill waste oxides such as mill scale, EAF dust and drop out dust. It is not intended, however, that this list be limiting and it is readily understood by a skilled artisan that additional compositions or combinations thereof which have iron oxide therein may find advantageous use according to the present invention.

The particulate iron oxide composition used in accordance with the invention need not be ground to pelletizing particle sizes (for example, typically 65% smaller than 44 microns); however, iron ore concentrates or fines that are already ground to pelletizing size, for example due to beneficiation requirements, may also be advantageously used in the present invention. Furthermore, in a preferred aspect of the invention the iron oxide composition may be ground to enhance reducibility if the size distribution is too large to achieve good reduction efficiency. If grinding is desired to improve reduction or for other reasons, it may preferably be achieved using a roll press or a ball mill, or other grinding devices known in the art. Additionally, in one aspect of the invention, the iron oxide composition is beneficiated to remove therefrom undesirable contaminants such as, for example, silica, alumina and sulfur.

In a preferred aspect of the present invention, the particulate iron oxide composition has a size distribution whereby substantially all of the particles are less than about 5 mm in diameter and at least about 90% of the particles have a particle size of less than about 2 mm. More preferably, substantially all of the iron oxide particles are less than about 2 mm in diameter and at least about 90% of the particles have a particle size of less than about 1 mm. In a preferred aspect of the invention, the average particle size of the particulate iron oxide composition is less than about 1 mm in diameter, more preferably less than about 500 $\mu$m, still more preferably less than about 250 $\mu$m, and most preferably less than about 100 microns. Suitable iron oxide compositions for use according to the present invention include magnetite concentrates from Minnesota and Michigan, specular hematite concentrates from Eastern Canada, hematite fines from Brazil, hematite fines from Australia, hematites from India, iron ores from Sweden and iron ores from South Africa. Suitable iron oxide compositions may be obtained from companies which are in the business of iron ore mining, such as, for example, Cleveland Cliffs, Inc., Quebec Cartier Mining Company, Iron Ore Company of Canada, CVRD, Hamersley Iron, BHP or MBR.

Another starting material needed to practice the present invention is a particulate carbonaceous reductant. A particulate carbonaceous reductant suitable for use in the present invention is one having a sufficient amount of reactivity, fixed carbon and volatile matter therein to advantageously react with the iron oxide composition under suitable reaction conditions to produce sponge iron. Examples of particulate carbonaceous reductants which are suitable for use in accordance with the invention include coal, coke, coke braize, pet coke, graphite and char. Again, it is not intended that this list be limiting, but only that it provide examples of useful carbonaceous reductants. It is well within the purview of a skilled artisan to select additional materials having sufficient reactivities, volatile matters, and fixed carbon therein to be advantageously used in accordance with this invention.

In a preferred aspect of the invention, the carbonaceous reductant has a particle size distribution whereby substantially all of the particles are less than about 5 mm in diameter with at least about 90% of the particles having a diameter of at most about 2 mm. More preferably, substantially all of the reductant particles are less than about 2 mm with at least about 90% of the particles having a diameter of at most about 1 mm. In a preferred aspect of the invention, the average particle size of a carbonaceous reductant is less than about 1 mm in diameter, more preferably less than about 500 microns, still more preferably less than about 200 microns, and most preferably less than about 74 microns. It is preferred that the carbonaceous reductant be finely ground, and it is well known in the art that these materials are relatively easy to grind. A suitable carbonaceous reductant may be readily obtained from sources well known to those skilled in the art.

In a preferred aspect of the invention, the carbonaceous reductant is beneficiated prior to being mixed together with the other starting materials. A preferred carbonaceous reductant, coal, commonly includes about 0.1–4% sulfur by weight and about 1–12% ash by weight as contaminants. For many uses of DRI, the sulfur must be removed from the metallic iron in very costly processing steps. As an example, the DRI product of conventional direct reduction processes commonly includes therein about 100–500 times more sulfur than that which may be present in iron used for making steel. This presence of sulfur in the DRI product is a major shortcoming of solids-based direct reduction processes in the prior art.

For the reasons stated above, preferred embodiments of the present invention involve grinding of the carbonaceous reductant before it is mixed with other starting materials, and then purifying the reductant with respect to fixed carbon content by removing ash and sulfur using beneficiation processes known in the art. Examples of suitable beneficiation techniques include flotation separation, heavy media separation, magnetic separation, rare-earth magnetic separation, chemical leaching, biochemical treatment and screening separation. This "front-end" beneficiation of the reductant allows the production of cleaner metallic iron and reduces the need for many costly purifying steps after the iron is metallized according to the invention.

One problem in the prior art associated with coal beneficiation is that the coal must first be slurrified due to its physical characteristics (including a relatively low density) and handling difficulties. This is problematic because subsequent drying of the purified coal is hazardous and expensive to achieve. Thus, beneficiation of carbon reductants has not been thought to be a viable option in association with presently-known direct reduction processes. In accordance with inventive processes, however, exhaust gases from the reduction reaction zone of the rotary hearth furnace are very low in oxygen and have a very high temperature. Therefore, the exhaust from an inventive reduction process provides an excellent drying stream for drying carbonaceous reductants after wet beneficiation. Utilization of exhaust gases in this manner also enables the efficient utilization of heat from the reduction process, which would otherwise be lost.

Another starting material advantageously utilized in accordance with particular preferred embodiments of the present invention is an additive which catalyzes the direct reduction reaction and/or desulfurizes the iron in the DRI product. As used herein with respect to particular inventive feed material mixtures, the term "additive" is intended to refer to a composition that, when present in an inventive feed material mixture according to the invention, enhances the rate of the reduction reaction, or, in other words, "catalyzes" the reduction of the iron oxide, and/or desulfurizes the iron in the DRI, therefore facilitating purification of the iron in downstream refining processes. It has been discovered by the present inventor that many additives advantageously perform both of these functions. Suitable additives for use in the advantageous practice of this invention include, for example, high calcium hydrated or slaked lime, dolomitic slaked lime, magnesian slaked lime, high calcium caustic lime, dolomitic caustic lime, magnesian caustic lime, high calcium limestone, dolomitic limestone, magnesian limestone, calcite and calcium carbide, According to particular aspects of the invention, multiple additives may be blended prior to mixing with the other starting materials. These additives may be obtained in the preferred powdered form from a wide variety of commercial outlets well known to a person skilled in the art.

Many additives, such as those described above, are detrimental to carbonaceous direct iron reduction processes taught in the prior art which utilize binders to form agglomerates or briquettes, because the additives interfere with the binders' ability to give the agglomerate adequate dry strength and durability. Therefore, if an additive is used in these processes, a much greater amount of binder is typically required to achieve satisfactory agglomeration, especially in the case of the FASTMET process, which handles dry green balls between the drier and the hot hearth. Due to the high costs of binders, as discussed above, the need for increased amounts of binders would result in an additional increase in material costs of about 1–3%. The elimination of the need for a binder in inventive processes eliminates this cost factor, making the use of the additives an advantageous feature of the invention.

The Present inventor has discovered that hydrated or slaked lime is used in accordance with the invention to achieve a particularly advantageous rate of the direct reduction reaction, increasing metallization of iron oxides by about 1 to about 10 percentage points for a given reaction time and reaction condition. The hydrated lime is especially advantageous in certain embodiments of the invention, i.e. those wherein the resulting metallic iron is to be used for steelmaking, because the use of this additive reduces the amount of lime which must be added to the metallized iron in downstream steel-making operations.

Another material which imparts advantageous features to inventive methods is water. The moisture content of the mixture advantageously imparts the following characteristics to inventive mixtures: (1) elimination of dust problems, (2) improved compaction characteristics of the mixture on the bed, (3) prevention of the ignition of the mixture upon contact with a hot hearth, (4) prevention of segregation of mixture components which occurs, for example, due to the large differences in density between the oxide, carbon and additive components and (5) delay of coal volatization so that, if the rotary hearth furnace flue is located at the beginning of the feed zone, as is common in a variety of prior art rotary hearth furnace designs, then the hydrocarbon volatiles of the coal have increased time to combust usefully in the hood to the benefit of the oxidic mixture. In view of the above benefits, the moisture content of a given mixture may be optimized according to the invention to minimize the drying load born by the hearth. Preferably the water content of the mixture is less than about 14% by weight, more preferably less than about 6% by weight, and most preferably less than about 4% by weight.

Starting materials are preferably mixed intensely according to the invention in appropriate proportions to maximize the efficiency of the overall direct reduction process. While it is well known that iron oxide compositions, such as iron ores, may have widely varying concentrations of iron atoms present therein, and that carbonaceous reductants may have widely varying amounts of fixed carbon present therein, the proportions of iron oxide composition to carbonaceous reductant are selected according to the invention based upon the amount of iron in the iron oxide composition and the amount of fixed carbon in the carbonaceous reductant.

According to a preferred aspect of the invention, the ratio of carbon to iron in the mixture is selected to optimize reduction of the iron oxide without wasting reductant. It is within the purview of a skilled artisan to determine the amount of fixed carbon in the reductant and the amount of iron in the iron oxide composition, and to stoichiometrically determine the weight proportions of these two components needed to achieve optimal reduction. In this regard, it is expected that about 50% of the fixed carbon in a reductant according to the invention will effectively perform a reducing function on the hearth. In a preferred aspect of the invention, the ratio of fixed carbon in the reductant to iron in the iron oxide composition is between about 4.0:10.0 and about 2.4:10.0 by weight. More preferably, the ratio is between about 3.4:10 and about 3.0:10 by weight. Most preferably the ratio of carbon to iron in the mixture is about 3.2:10.0 by weight.

The relative amount of additive which is included in mixtures according to the present invention will be dependent upon the specific additive selected for use and the amount of iron and fixed carbon in the iron oxide composition and reductant, respectively. Additionally, the amount of water present may be optimized by taking into account the factors listed above. An optimum amount of each of these components may readily be determined by one skilled in the art with minimal experimentation. In one preferred embodiment, an inventive mixture comprises less than about 0.1% additive and from about 0.5% to about 14% water, both by weight. In another preferred embodiment, a mixture according the invention comprises from about 0.1% to about 10% additive by weight; and from about 0.5% to about 14% water by weight.

In one preferred aspect of the invention, the particulate iron oxide composition is hematitic or magnetitic virgin iron ore or concentrates thereof; the carbonaceous reductant is one or a blend of more than one low or medium volatile bituminous or subbituminous coals; and the additive is one or a blend of more than one of the following compositions: high calcium hydrated or slaked lime, dolomitic slaked lime, magnesian slaked lime, high calcium caustic lime, dolomitic caustic lime, magnesian caustic lime, high calcium limestone, dolomitic limestone, magnesian limestone, calcite and calcium carbide. Preferably, the mixture comprises from about 65% to about 85% virgin ore; from about 10% to about 30% low to medium volatile bituminous or subbituminous coal; from about 0.5% to about 8% additive; and from about 1% to about 10% water, all by weight. In this embodiment, the dry-weight-basis iron content of the iron ore is from about 64% to about 70% and the dry-weight-basis fixed carbon of the carbonaceous reductant is from about 60% to about 80%. More preferably, the mixture comprises from about 73% to about 79% low silica iron ore fines or concentrate by weight; from about 18% to about 22% low to medium volatile bituminous or subbituminous coal by weight; from about 0.5% to about 3% powdered additive by weight; and from about 2% to about 4% water by weight.

The components are preferably mixed in the dry form, with the optional addition of water to achieve the features discussed above. Alternatively, if for example, a fine-grained magnetite concentrate in wet filter cake form is used as a starting material, then little or no water would be added such that the filter cake moisture (typically 9–11%) is reduced by the addition of dry constituents to approximately 7% by weight.

Figure 2:
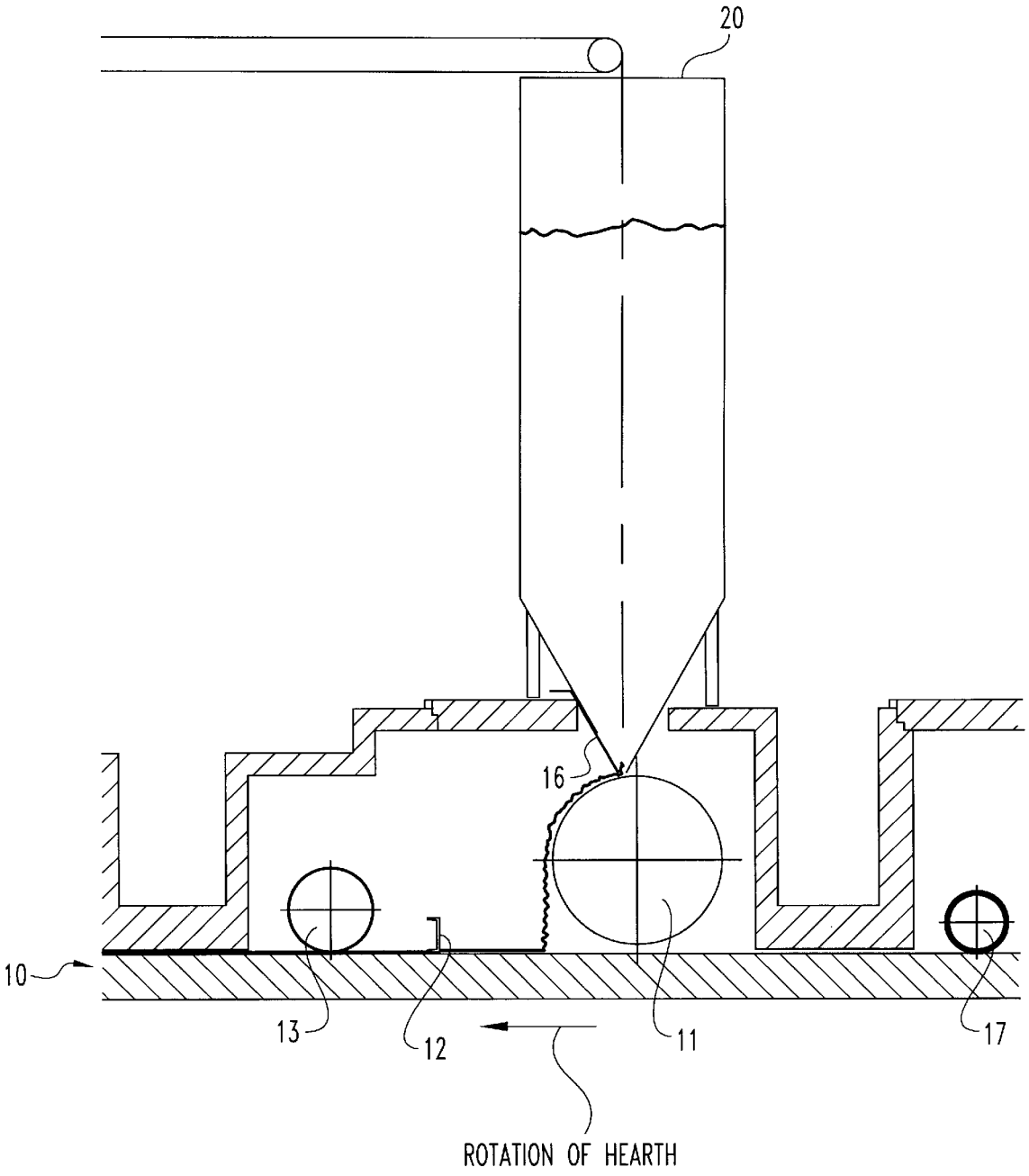
FIG. 2 provides a side elevational view of a portion of a rotary hearth furnace according to a preferred aspect of the invention, the portion including the feed zone, and having depicted therein a feed drum for introducing feed material onto the hearth, a leveling plow and a single compacting drum.

In a preferred manner of practicing the invention, each component of the mixture is carefully weigh-fed into an intensive mixer or pug mill to thoroughly blend the mixture. A mixture prepared or obtained as described above may then be introduced onto a rotary hearth furnace for reduction to sponge iron. For example, referring to FIGS. 1 and 2, in one preferred manner of introducing an inventive mixture onto the hearth of a rotary hearth furnace, the moist, blended mixture may be conveyed on, for example, a belt conveyor, to a feed bin (also capable of functioning as a surge bin 20, as discussed more fully below) spanning the width of the hearth. Preferably, the feed bin is designed to handle the optimized moisture content of the mixture without bridging. Steep wall slopes, bin vibrators, and/or live bin bottoms may preferably be used to aid in the gravity flow of a moist mixture. Depending upon the starting materials used, the moist mixture may preferably be removed from the bin through, for example, a slide gate 16 by either a drum drag feeder 11 (optionally equipped with cleats) or a star feeder (not shown). The feeder in this embodiment preferably spans the full width of the bin and the hearth. The feed area is preferably shrouded, sealed, and fed with nitrogen gas to purge air and eliminate the hazard of combustion of the carbon in the mixture upon contact with the hot hearth.

One problem commonly encountered in the use of a rotary hearth furnace is that the tangential speed of the "inside" edge of the hearth is different than the tangential speed of the "outside" edge of the hearth, due to the difference in radius between the inside edge and the outside edge of the hearth. This speed differential must be taken into account in order to achieve a relatively even layer of feed material on the hearth across the width of the hearth. There are several generally understood and accepted solutions in the related field for distributing and feeding materials onto a rotating hearth such that the feed material will be placed relatively evenly across the width of the hearth, and it is within the purview of a skilled artisan to assemble a material feed system for feeding the material onto the hearth in a relatively uniform layer. Examples of these include (1) vibrating feeder-conveyors with feed openings cut in a tapered fashion to proportion feed between inside and outside radii of the hearth, (2) drag feeders with slide chutes with vane deflectors to distribute more material to the outer portion of the hearth and less to the inner portion, (3) star feeders with tapered sectors, and (4) tapered drum drag feeders.

Figure 3:
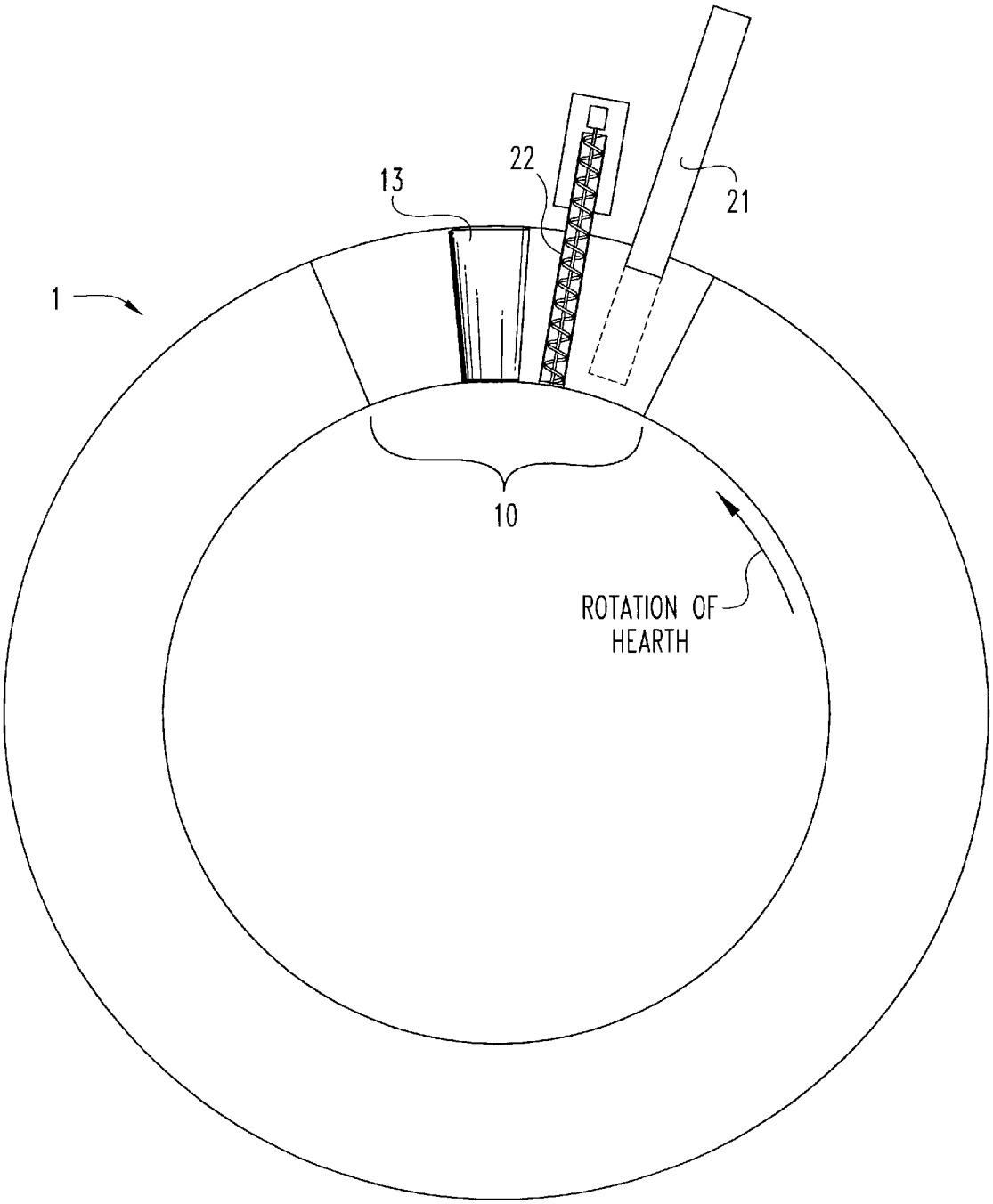
FIG. 3 provides a top plan view of a portion of a rotary hearth furnace according to a preferred aspect of the invention, the portion including the feed zone, and having depicted therein an oscillating conveyor for introducing feed material onto the hearth, a leveling screw and a single compacting drum.

In another preferred manner of introducing the mixture onto the hearth, the moist, blended mixture may be conveyed to an oscillating conveyor 21. The oscillating conveyor from which the feed mixture drops onto the hearth may advantageously be moved back and forth repeatedly across the width of the hearth, thus introducing feed material onto the hearth as the hearth steadily moves thereunder. The oscillating conveyor 21 in a preferred embodiment is oriented as shown in FIG. 3, and a relatively even layer of feed material on the hearth is achieved by a movement of the conveyor back and forth with greater speed at the "inside" end of the stroke. The eccentric oscillation allows the oscillating conveyor 21 to feed the mixture across the width of the hearth.

While measures such as those described above may be taken to achieve relative evenness, it is preferred that the layer be smoothed even more uniformly before entering the reaction zone. A mixture layer on the hearth may be leveled using, for example, a set of stationary or oscillating plows 12 or a leveling screw 22 that sweep excess material to the inside or outside of the hearth. Excess material may preferably be swept off the hearth and recycled to the feed system. It is also preferred that the mixture layer which enters the reaction zone of the rotary hearth furnace has a loose-layer thickness of less than about 100 mm. More preferably, the thickness is less than about 30 mm, yet more preferably less than about 20 mm and most preferably less than about 15 mm; however, it is readily understood that the most preferred thickness may be dependent upon the heat transfer conditions of the particular furnace being used.

The type and arrangement of burners, the type and arrangement of secondary air used to combust the coal volatiles and carbon monoxide, and the type of combustion fuel used are examples of some of the variables that will impact heat transfer conditions of the particular furnace. Additionally, if the hearth is super-heated, a thicker layer may be loaded onto the hearth since heat will be conducted from the hearth into the bottom of the layer, thereby achieving the direct reduction of material not directly exposed to the radiant heat from above the hearth. A thicker layer may also be placed on the hearth in alternative embodiments of the invention where the mixture layer is "plowed," "churned" or "shaved" at one or more points within the reaction zone of the rotary hearth furnace. For example, in one preferred embodiment, a large layer, for example, up to about 100 mm thick, is reacted in the first zone of a multi-zone furnace, then the top 5 to 20 mm is shaved off the hearth by a discharge screw or plow. Thereafter, the remaining "fresh" material continues reacting in the next zone. This sequence can be repeated with a number of zones and shaving steps in one rotation of the circular hearth.

In an alternate preferred embodiment, the layer of the mixture which is introduced onto the hearth may be compacted using a compacting device before entry into the reaction zone. For example, the mixture may be compacted on the hearth using one or more tapered drums 13 rotating by friction with the bed or using, for example, one or more rollers, tires or cylinders. In this embodiment, the preferred thickness of the post-compacted layer is preferably less than about 30 mm, more preferably less than about 15 mm. In another alternate embodiment, the compacting device 13 comprises a plurality of texturing devices for imparting various surface features or textures to the compacted layer, such as for example, grooves, windrows, holes or slots. The texturing devices enhance reaction efficiency, degree of metallization, uniformity of reaction and ease of removal of the reduced bed or compact from the hearth in the discharge zone. While it is not intended that the present invention be limited by any mechanism whereby it achieves its advantageous result, it is believed that such surface features or textures improve the efficiency of the reduction process by increasing the surface area of the mixture which is exposed to radiant heat in the reaction zone.

In the reaction zone, the mixture, either in compacted or uncompacted form, is heated to a temperature and for a period of time sufficient to achieve a high degree of reduction of the iron oxide composition to metallic iron. In a preferred aspect of the invention, the mixture is heated to a temperature of from about 1000° C. to about 1500° C. and for a period of time of from about 3 minutes to about 30 minutes. Conventional rotary hearth furnaces having multiple reaction zones may be advantageously used in accordance with the present invention. Since there is no threat of green ball explosion or breakage in inventive processes, such as those which may occur in other direct iron reduction systems known in the art by rapid heating of agglomerates, the mixture can be heated more rapidly than prior art. This feature, coupled with the lower moisture content of the mixture (preferably about 3%) and the elimination of void space on the hearth, provides the ability, using inventive methods, to greatly increase output of DRI at higher and more uniform metallization as compared to prior art reduction techniques.

After passing through the reaction zone or zones on the rotary hearth furnace, the reduced material (sponge iron), either in a compacted or uncompacted form, is removed from the hearth. The sponge iron is preferably removed using one or more water-cooled discharge plows or screws 17, and may then be discharged through refractory-lined chutes into, for example, insulated and nitrogen purged bottles or a nitrogen-purged hot conveyor or pneumatic conveyance system for transport to further processing steps. Alternatively, the product may be hot briquetted or cooled and prepared for merchant sale. These and other techniques for handling sponge iron are well within the purview of a skilled artisan. In a preferred aspect of the invention, at least about 70% of the iron in the sponge iron is in metallic form, more preferably, at least about 80% of the iron is in metallic form, still more preferably at least about 90% and, most preferably, at least 95%.

It is an advantageous feature of the present invention that the starting materials are not agglomerated, as is required in conventional rotary hearth direct reduction processes. Since no balling, briquetting or other agglomeration is performed, no binding agents, balling disks, balling drums, roll screens or briquetting machines are required in the process and capital and operating costs of the process are therefore substantially reduced. Additionally, since there is no wet agglomeration step prior to introducing the mixture onto the hearth, there is no need to undergo capital-intensive and costly drying steps prior to introduction of the starting materials onto the hearth. Also, due to the lower moisture content of the furnace charge according to the present invention, the drying task on the hearth is reduced substantially, the result being substantially greater unit productivity of the hearth. Furthermore, the avoidance of agglomerated starting materials enables a greater efficiency of metallization because the burden on the hearth has greater density and less air space which results from use of the agglomerates laid in a bed.

The elimination of agglomeration steps also overcomes the problem of explosion of wet green balls when they are placed onto a hot hearth. To avoid green ball explosion or cracking, prior art rotary hearth furnace processes required, in addition to very high dosages of binders, that the hearth be cooled prior to introduction of the agglomerates therein to avoid thermal shock to the wet green balls, thereby preventing green ball explosion. The consequence of this cooling however is a substantial loss in thermal efficiency and unit productivity of the rotary hearth reduction furnace. The present invention avoids this efficiency and productivity penalty. In contrast, the present invention provides as an option the preheating of the hearth prior to placement of the mixture onto the hearth thereby gaining productivity and efficiency in the direct reduction process. If this option is used, the preheated hearth aids in the metallization of the bottom materials of the mixture thereon, and thereby overcomes a limiting condition in the prior art of rotary hearth reduction where the bottom layer of agglomerates dictate the degree of metallization and productivity. Since there is no agglomeration associated with the reduction method of the present invention, the risks of agglomerate thermal shock and green ball explosion are eliminated.

Another advantage of avoiding the formation of agglomerates is the very high cost of using such high concentrations of synthetic and bentonite clay binders. In many conventional reduction processes which utilize green balls, these binders are often the fourth largest cost component of the reduction process, behind the ore, the solid reductant and combustion fuel (with the cost of binders in some locations being greater than that of combustion fuel). Therefore, the avoidance of this cost component is a very desirable advantage of the invention, and provides a cost advantage of up to 15% of total cash costs of DRI production. Furthermore, as discussed above, with the avoidance of agglomeration, and therefore the elimination of the need for binder materials, preferred inventive methods advantageously may include a wide variety of additives, as described above. In prior art carbonaceous direct reduction processes, it was commonly disadvantageous with respect to overall process efficiency to use additives such as those described herein, because they are known to interfere with the efficacy of binders used in the prior art. Therefore, the use of these additives was previously thought to necessitate an increased dose of binders, thus reducing the economic efficiency of prior art direct reduction processes. A wide variety of additives, however, may be put to advantageous use in preferred processes of the present invention.

Another excellent feature of the invention, which arises from the use of particulate materials rather than agglomerates, is that a surge bin 20 may be used. As discussed briefly above, a surge bin 20 is a container for holding feed material prior to introducing the material onto the hearth, and provides a buffer in the event that there is an interruption of some kind in a pre-hearth step of the overall reduction process. While a surge bin is not feasible (in the case of green ball processing) or is only minimally useful (in the case of dried agglomerates) in prior art carbonaceous direct reduction processes, a surge bin 20 is a useful tool in accordance with inventive processes. The surge bin 20 may preferably be placed immediately adjacent or above the loading region of the hearth, and the feed material may be introduced directly from the surge bin 20 onto the hearth or indirectly via a feeder and conveyor arrangement.

The presence of a surge bin 20 allows a process according to the invention to run more continuously, even where a prior processing step is interrupted. This prevents the need to restart and reheat the furnace, as would be required if the process were intermittently stopped, this greatly improving overall thermal efficiency of the process. Additionally, minimizing interruptions and, thus reducing "down time," helps to optimize output of the hearth and also yields a higher quality product. All of these factors result in substantial advantages over reduction processes known in the prior art.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected. The invention will be further described with reference to the following specific Examples. It will be understood that these Examples are also illustrative and not restrictive in nature.

EXAMPLE ONE

Specular hematite concentrate containing less than 5% silica and more than 64% elemental iron by weight is ground by either a ball mill or roll press to a nominal particle size distribution of at least 50% passing 200 mesh. The ground iron ore concentrate is admixed with low volatile subbituminous coal containing about 77% fixed carbon by weight on a dry basis, which has been dried and ground to a size of about 80% passing 200 mesh. Hydrated lime in powder form is also admixed at a dosage of 1% of the dry mixture. The entire mixture is wetted to 3.0% water content in an intensive mixer. The moist mixture is conveyed to and placed in a uniform and compacted layer of 15 mm thickness on a rotary hearth furnace in a shrouded, sealed and nitrogen-purged feed zone. The mixture is rapidly heated by natural gas and/or coal fired burners to approximately 1300° C. Residence time in the furnace is approximately 10 minutes. Metallization in excess of 90% is achieved with a unit productivity of the hearth of more than 70 kg of DRI per useful square meter of hearth area per hour. The mixture is removed from the hearth using a water cooled screw, discharged to a refractory lined bottle for transfer to an electric arc furnace to be hot charged into the EAF melt.

EXAMPLE TWO

Magnetite concentrate from Minnesota or Michigan with a silica content between 1.5% and 6.0% is ground to at least 80% passing 325 mesh, and filtered to a moisture content of about 10%. It is then mixed with a reductant mix of a dry ground blend of 50% pet coke and 50% high fixed carbon, low volatile coal together with a 2% dosage of powdered hydrated lime. The mix recipe by weight is 72% iron ore concentrate, 19% reductant mix, 7% water and 2% hydrated lime. The thoroughly blended mixture is conventionally conveyed and, using an oscillating conveyer, spread across the full hearth width of the rotary hearth reduction furnace. Using one or more leveling screws the mixture is spread into an even layer approximately 25 mm thick. Seven rotating cylinders, each one meter wide, rotate by friction with the bed, compacting the layer to a thickness of about 18 mm. The compacting drums also impart windrow grooves about 2 mm wide at a spacing of about 30 mm. Radial grooves of 2 mm width are also imparted into the wet compact at a spacing of 10–15 cm to enhance removal of the "slabs" of DRI in the discharge zone. An oscillating, water-cooled plow scrapes the pieces of DRI, or sponge iron, off the hearth in the discharge zone. The plow oscillates with an amplitude of about six inches with an outflow velocity one half that of the return stroke so that the plow gets back to the start position before the inner 6 inch material travels behind the plow on the out stroke. The hot pieces of sponge iron are discharged to a hot briquetting machine where the sponge iron is densified into briquettes for merchant sale.

EXAMPLE THREE

Hematite fines at about 4% moisture from South America or Australia are ground using a high pressure roll press to 50% minus 200 mesh and then admixed with a coal blend containing 75% fixed carbon and 17% volatiles. The coal blend has been dry ground to about 80% smaller than 100 microns. The moist ground ore and dry coal are mixed with dolomitic hydrated lime at a ratio of 77% ore, 22% coal and 1% dolomitic hydrated lime, by weight. The blend is intensively mixed in a pug mill before belt conveyance to an oscillating conveyer that distributes the mix across a 7.0 meter wide rotary hearth. High temperature alloy plows level the bed to 15 mm and a tapered drum with conical points compacts the bed to about 10 mm thickness with conical depressions in a pattern with cones spaced every 3 cm with a conical base diameter of 8 mm and a length of 10 mm. The entire feed zone is shrouded, sealed and charged with nitrogen gas to eliminate flashing as the carbonaceous mixture cascades down onto a hearth with a surface temperature of 1000° C. Reaction time including drying time is approximately 10 minutes to 12 minutes. The DRI bed is removed in the discharge zone by a water cooled discharge screw with a diameter of 36 inches. DRI with average metallization of 95% is passed into nitrogen filled bottles lined with refractory. The hot DRI is transported to a submerged arc furnace for melting and further refining.

What is claimed is:

1. A method for producing direct reduced iron, comprising:

providing a mixture of a particulate iron oxide composition and a particulate carbonaceous reductant, the mixture being substantially free from agglomeration;

positioning the mixture onto a rotary hearth furnace;

compacting the mixture using a compacting device to form a compacted mixture;

subjecting the compacted mixture to reducing conditions to reduce a substantial portion of the iron oxide, thereby producing sponge iron; and discharging the sponge iron from the rotary hearth furnace.

2. The method according to claim 1, wherein the particulate iron oxide composition comprises particles, substantially all of the particles being less than about 5 mm in diameter.

3. The method according to claim 2, wherein about 90% of the particles are less than about 2 mm in diameter.

4. The method according to claim 1, wherein the particulate carbonaceous reductant comprises particles, substantially all of the particles being less than about 5 mm in diameter.

5. The method according to claim 4, wherein about 90% of the particles are less than about 2 mm in diameter.

6. The method according to claim 1, wherein the mixture comprises particles having an average particle size of less than about 500 $\mu$m in diameter.

7. The method according to claim 1, wherein the particulate carbonaceous reductant comprises a member selected from the group consisting of coal, coke, coke braize, pet coke, graphite and char.

8. The method according to claim 1, wherein the particulate iron oxide composition comprises a member selected from the group consisting of virgin iron ore and steel mill waste oxides.

9. The method according to claim 1, said positioning comprising positioning the mixture onto a rotary hearth furnace in a substantially uniform layer.

10. The method according to claim 9, wherein the substantially uniform layer is less than about 100 mm thick.

11. The method according to claim 10, wherein the substantially uniform layer is less than about 30 mm thick.

12. The method according to claim 1 wherein said subjecting comprises exposing the mixture to a temperature of between about 1000° C. and about 1500° C. for between about 3 minutes and about 30 minutes.

13. The method according to claim 1, wherein at least about 70% of iron in the sponge iron is in metallic form.

14. The method according to claim 1, wherein at least about 80% of iron in the sponge iron is in metallic form.

15. The method according to claim 1, wherein at least about 90% of iron in the sponge iron is in metallic form.

16. The method according to claim 1, wherein the dry weight ratio of fixed carbon in the reductant to iron in the iron oxide composition is from about 4.0:10 to about 2.4:10.

17. The method according to claim 1, wherein the dry weight ratio of fixed carbon in the reductant to iron in the iron oxide composition is from about 3.4:10 to about 3.0:10.

18. The method according to claim 1, wherein the mixture further comprises water.

19. The method according to claim 1, wherein the particulate iron oxide composition comprises a member selected from the group consisting of hematite iron ore fines, ground lump ores, iron oxide pellet fines, hematite iron ore, specular hematite concentrate, earthy hematite, magnetite iron ore, magnetite concentrate, limonite, limonite concentrate, ilmenite, ilmenite concentrate, taconite concentrate, semi-taconite concentrate, pyrolusite, pyrolusite concentrate, mill scale, EAF dust and drop out dust.

20. The method according to claim 1 wherein the compacting device comprises a plurality of texturing devices.

21. The method according to claim 18, wherein the mixture further comprises an additive.

22. The method according to claim 21, wherein the mixture comprises from about 0.1% to about 10% additive by weight; and from about 0.5% to about 14% water by weight.

23. The method according to claim 21, wherein the additive catalyzes the reduction of iron oxide into elemental iron.

24. The method according to claim 21, wherein the additive desulfurizes elemental iron in the sponge iron.

25. The method according to claim 21, wherein the additive comprises a member selected from the group consisting of hydrated or slaked lime, dolomitic hydrated lime, magnesian hydrated lime, caustic lime, dolomitic caustic lime, magnesian caustic lime, limestone, dolomitic limestone, magnesian limestone and calcium carbide.

26. The method according to claim 21, wherein the particulate iron oxide composition comprises hematitic or magnetitic virgin iron ore or a concentrate thereof; wherein the carbonaceous reductant comprises a low to medium volatile, bituminous or subbituminous coal; and wherein the additive comprises one or more members selected from the group consisting of high calcium hydrated or slaked lime, dolomitic slaked lime, magnesian slaked lime, high calcium caustic lime, dolomitic caustic lime, magnesian caustic lime, high calcium limestone, dolomitic limestone, maqnesian limestone, calcite and calcium carbide.

27. The method according to claim 26, wherein the mixture comprises from about 10% to about 30% low to medium volatile, bituminous or subbituminous coal by weight; from about 65% to about 85% virgin iron ore by weight; from about 0.1% to about 8% additive by weight; and from about 1% to about 10% water by weight.

28. The method according to claim 25, wherein the mixture comprises from about 18% to about 22% low to medium volatile bituminous or subbituminous coal by weight; from about 73% to about 79% low silica iron ore fines or concentrate by weight; from about 0.5% to about 3% powdered additive be weight; and from about 2% to about 4% water by weight.

29. The method according to claim 1, wherein said positioning comprises positioning the mixture onto a loading zone of a rotary hearth furnace, the loading zone being shrouded, sealed and nitrogen purged.

30. The method according to claim 1, wherein the mixture is placed in a surge bin before said positioning.

31. The method according to claim 1, further comprising beneficiating the carbonaceous reductant with respect to fixed carbon content before said providing.

32. The method according to claim 1, further comprising beneficiating the iron oxide composition with respect to iron content before said providing.

33. A method for producing direct reduced iron, comprising:

providing a mixture of a particulate iron oxide composition and a particulate carbonaceous reductant;

positioning the mixture onto a rotary hearth furnace; compacting the mixture using a compacting device to form a compacted mixture;

subjecting the compacted mixture to reducing conditions to reduce a substantial portion of the iron oxide, thereby producing sponge iron;

discharging the sponge iron from the rotary hearth furnace; and introducing the sponge iron into a submerged arc furnace.

34. The method according to claim 33, wherein the sponge iron comprises a metallic iron component and an iron oxide component; and wherein the method further comprises:

melting the sponge iron; and reducing the iron oxide component in the submerged arc furnace, thereby producing a gangue-free liquid iron and a liquid slag.

* * * * *